US007915515B2

(12) United States Patent
Guillaume

(10) Patent No.: US 7,915,515 B2
(45) Date of Patent: Mar. 29, 2011

(54) DEVICE FOR PRODUCING SIGNALS REPRESENTATIVE OF SOUNDS OF A KEYBOARD AND STRINGED INSTRUMENT

(75) Inventor: Philippe Guillaume, Toulouse (FR)

(73) Assignee: Modartt, Ramonville Saint Agne (FR)

( * ) Notice: Subject to any disclaimer, the term of this patent is extended or adjusted under 35 U.S.C. 154(b) by 99 days.

(21) Appl. No.: 12/303,419

(22) PCT Filed: Jul. 13, 2007

(86) PCT No.: PCT/FR2007/001199

§ 371 (c)(1),
(2), (4) Date: Dec. 18, 2008

(87) PCT Pub. No.: WO2008/012412

PCT Pub. Date: Jan. 31, 2008

(65) Prior Publication Data

US 2009/0241757 A1 Oct. 1, 2009

(30) Foreign Application Priority Data

Jul. 28, 2006 (FR) ..... 06 06937

(51) Int. Cl.
*G10H 1/06* (2006.01)

(52) U.S. Cl. ..... 84/735; 84/622; 84/625; 84/659; 84/660; 84/662; 84/737

(58) Field of Classification Search ..... None
See application file for complete search history.

(56) References Cited

U.S. PATENT DOCUMENTS 5,264,658 A * 11/1993 Umeyama et al. ..... 84/661
6,647,359 B1 * 11/2003 Verplank et al. ..... 703/2

OTHER PUBLICATIONS

Julien Bensa, "Analyse et synthèse de sons de piano par modèles physiques et de signaux", These de Doctorat, May 23, 2003, pp. 1-183, Universite de la Mediterranee, Marseille, France.
N. Giordano et al., "Physical Modeling of the Piano", EURASIP Journal on Applied Signal Processing, Jul. 2004, pp. 926-933, vol. 2004, No. 7, Hindawi Publishing Corporation, USA.
Balézs Bank et al., "Physically Informed Signal Processing Methods for Piano Sound Synthesis: A Research Overview", EURASIP Journal on Applied Signal Processing, Oct. 2003, pp. 941-952, vol. 2003, No. 10, Hindawi Publishing Corporation, USA.

(Continued)

*Primary Examiner* — Marlon T Fletcher
(74) *Attorney, Agent, or Firm* — Young & Thompson

(57) ABSTRACT

A device for digitally producing signals representative of sounds having a sonority simulating that of an instrument with keyboard and strings that are linked to a sounding board of the instrument, these sounds each corresponding to a note of the instrument. The device produces at least one signal representative of a keyboard and stringed instrument sound on the basis of at least one trigger signal and parameters, termed physical parameters. The physical parameters include at least one parameter, the so-called sounding-board parameter, characteristic of a sounding board of a keyboard and stringed instrument to be simulated. Furthermore, the physical parameters according to the invention comprise at least one parameter, termed the string(s) parameter, characteristic of at least one string of the keyboard and stringed instrument to be simulated. The device includes elements (9, 10, 11, 33) for inputting at least one physical parameter.

24 Claims, 5 Drawing Sheets

OTHER PUBLICATIONS

Figure 1:
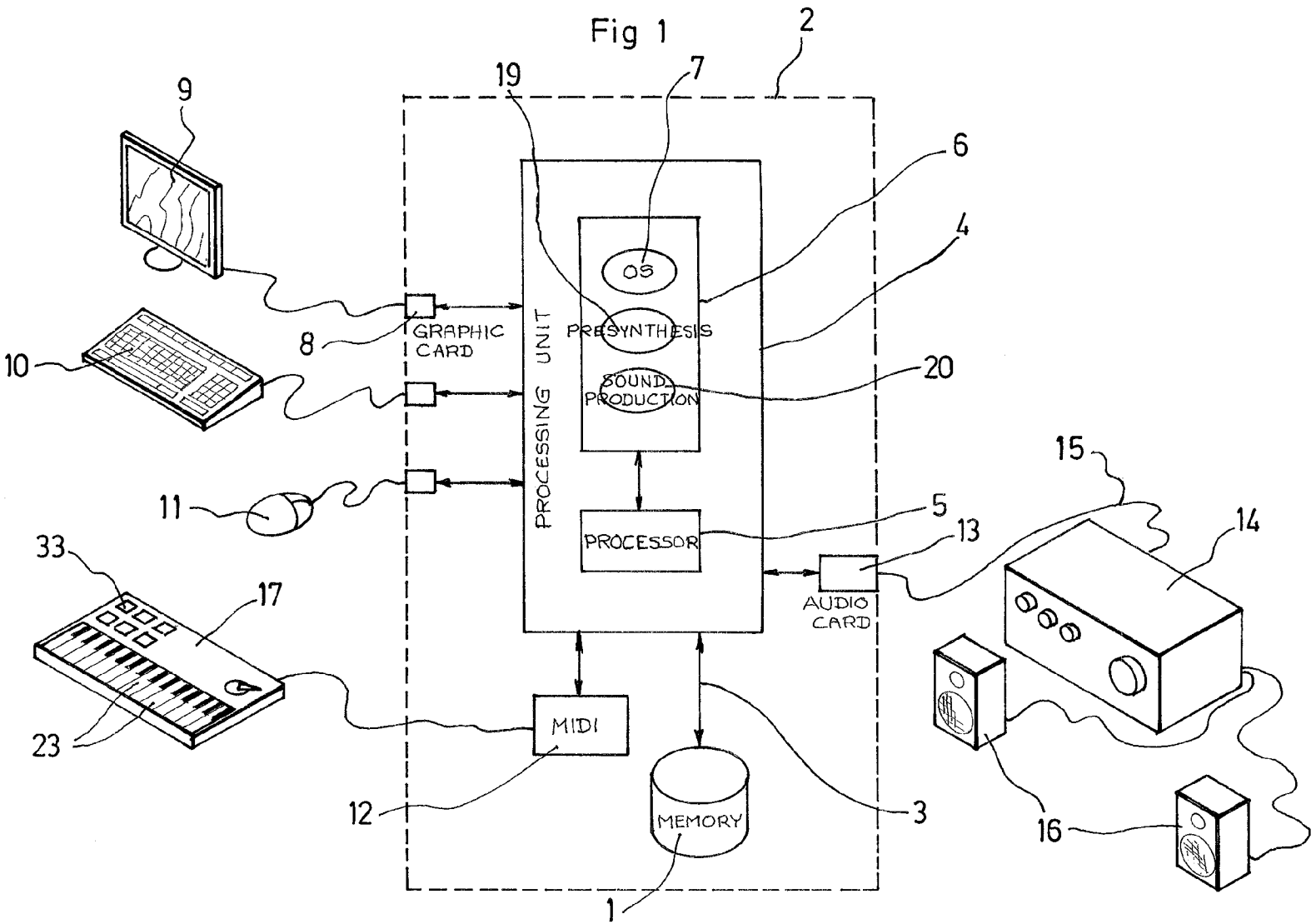

Rudolf Rabenstein et al., "Digital sound synthesis of string instruments with the functional transformation method", Aug. 2003, pp. 1673-1688, vol. 83, No. 8, Signal Processing, Amsterdam, The Netherlands.
Julien Bensa et al, "The simulation of piano string vibration: From physical models to finite difference schemes and digital waveguides", Journal of the Acoustical Society of America, Aug. 2003, pp. 1095-1107, vol. 114, No. 2, AIP/Acoustical Society of America, Melville, New York, USA.
Scott A. Van Duyne et al., "Developments for the Commuted Piano", Proceedings of the International Computer Music Conference, Sep. 1995, pp. 319-326, ICMC.
N. Giordano, "Mechanical impedance of a piano soundboard", Journal of the Acoustical Society of America, Apr. 1998, pp. 2128-2133, vol. 103, No. 4, Acoustical Society of America through AIP, USA.
N. Giordano, "Simple model of a piano soundboard", Journal of the Acoustical Society of America, Aug. 1997, pp. 1159-1168, vol. 102, No. 2, Acoustical Society of America through AIP, USA.
Guy E. Garnett, "Modeling piano sound using Waveguide Digital Filtering Techniques", ICMC Proceedings, 1987, pp. 89-95.
Philippe Guillaume, "Nonlinear Eigenproblems", SIAM J. Matrix Anal. Appl., 1999, pp. 575-595, vol. 20, No. 3, Society for Industrial and Applied Mathematics.
Philippe Guillaume et al., "Solution to the Time-Harmonic Maxwell's Equations in a Waveguide; Use of Higher Order Derivatives for Solving the Discrete Problem", SIAM J. Numer. Anal., Aug. 1997, pp. 1306-1330, vol. 34, No. 4, Society for Industrial and Applied Mathematics.
Jean-Daniel Beley et al., "Application de la méthode des dérivées d'ordre élevéà l'optimisation de structures", Revue Européenne des Éléments Finis 5, 1996, pp. 537-567.
Ph. Guillaume et al., "Sensitivity computation and automatic differentiation", Control and Cybernetics, 1996, pp. 831-865, vol. 25, No. 5.
Ph. Guillaume et al., "Computation of high order derivatives in optimal shape design", Numerische Mathematik 67, 1994, pp. 231-250, Springer-Verlag.
Philippe Guillaume et al., "Calcul numérique des dérivées d'ordre supérieur en conception optimale de formes", C. R. Acad. Sci. Paris, 1993, pp. 1091-1096, t. 316, Series I.
Philippe Guillaume et al., "Dérivées d'ordre supérieur en optimisation de domaines", C. R. Acad. Sci. Paris, 1992, pp. 859-862, t. 315, Series I.
M. Masmoudi et al., "Application of Automatic Differentiation to Optimal Shape Design", Advances in Structural Optimization, 1995, pp. 413-446, Kluwer Academic Publishers, The Netherlands.
Philippe Guillaume, "Nested multivariate Padé approximants", Journal of Computational and Applied Mathematics 82, 1997, pp. 149-158.
Philippe Guillaume, "Convergence of the Nested Multivariate Padé Approximants", Journal of Approximation Theory 94, Academic Press, Article No. AT983204, 1998, pp. 455-466, Elsevier Science B.V., Amsterdam, The Netherlands.
Philippe Guillaume et al., "Generalized Multivariate Padé Approximants", Journal of Approximation Theory 95, 1998, pp. 203-214, Article No. AT973216, Academic Press.
Philippe Guillaume et al., "Multivariate Padé approximation", Journal of Computational and Applied Mathematics 121, 2000, pp. 197-219, Elsevier Science B.V.

* cited by examiner

PROCESSING UNIT
OS
PRESYNTHESIS
SOUND PRODUCTION
PROCESSOR
AUDIO CARD
MEMORY
MIDI
GRAPHIC CARD
1
2
3
4
5
6
7
8
9
10
11
12
13
14
15
16
17
19
20
23
33

DEVICE FOR PRODUCING SIGNALS REPRESENTATIVE OF SOUNDS OF A KEYBOARD AND STRINGED INSTRUMENT

The invention relates to a device for production, by digital means, of signals that are representative of sounds having a sonority simulating that of a instrument having a keyboard and having strings that are linked to a sounding-board of the instrument, these sounds each corresponding to a note of the instrument.

Methods are known for production of piano sounds by digital means in real time starting from piano sounds recorded beforehand. In such methods, the timbre of the sounds produced depends on the sonority of the piano, known as the piano of origin, having produced the recorded sounds. Thus processes are known, according to which the prerecorded sounds are modified in the course of a processing chain with a view to modulating the timbre of the piano sounds obtained at the end of the chain. These modifications are obtained by application of signal-processing techniques. However, the timbre of the piano sounds produced in this way remains, despite these modifications, closely linked to the character of the sonority of the piano of origin. In addition, the implementation of these methods requires a significant memory space in order to store prerecorded piano sounds in large number with a view to producing piano sounds of high quality.

In addition, methods are known (cf. in particular the publications "Modeling piano sound using waveguide digital filtering techniques" Guy E. Garnett, 1987 ICMC Proceedings, and "Physically informed signal processing methods for piano sound synthesis: a research overview" EURASIP Journal on Applied Signal Processing 2003:10, 941-952 XP-002419785), so-called methods of synthesis by means of waveguides, according to which a resonator of the musical instrument (a piano string, for example) is represented by means of a delay loop including units for linear processing of the signal (in particular, filters), the transfer function of which is determined as a function of the properties (resonance and attenuation) of the resonator. With a view to the synthesis of each note, a waveform is introduced into the delay loop by way of excitation.

In these methods, the form of the excitation waves and the design parameters of the filters of the delay loop are obtained either by a manual adjustment, by trial and error, of each filter for each instrument configuration to be simulated (which is long-winded, complex, provides results that are not very faithful, and does not allow quick and easy changes of configuration), or starting from a recorded signal picked up on an acoustic piano of traditional construction (the simulation then being very imperfect, since a real piano is not constituted by a network of waveguides). Consequently the field of application of these methods by means of waveguides is strictly limited to the imperfect and not very realistic imitation of the sonority of a single instrument which corresponds to the manual adjustments of the filters, or from which the recording of the recorded signal is drawn.

Moreover, if it has indeed been possible to think of using a complete physical modelling of the instrument (for example, with a grid and a digital analysis of the type by means of finite elements, or equivalent), it is clear that such a method, requiring an enormous number of calculations for each sound to be produced, remains totally incompatible with a simulation in real time using the data-processing devices currently available.

Document BENSA J.: "Analyse et synthèse de sons de piano par modèles physiques et de signaux", doctoral thesis, Université de la Mediterranée, 23 May 2003, XP 007903720, describes a method for synthesis of piano sounds which is based on coupled digital waveguides, in order to model the transfers of energy between the strings, the source of the model having been simulated by a signal model by means of subtractive synthesis, enabling a digital piano to be obtained, certain timbre characteristics of which can be modified. This document provides for using a hybrid module including a model, described as 'physical', in order to simulate the behaviour of the instrument, and a signal model in order to simulate the effect of perception produced by the instrument. The resonator is modelled by using digital waveguides, the source of which is itself modelled by using a non-linear signal model corresponding to the hammer/string interaction according to a subtractive synthesis. In this document, only the most pertinent physical characteristics of the strings of the piano and of the speed of the hammer are taken into account in the hybrid model. In particular, the sounding-board is not modelled. This document therefore provides that the sounding-board could be taken into account by a set of linear filters which are identified for each note from measurements on a real piano, each filter being subject to a convolution with the excitation signal in order to create an aggregated excitation table. With such a model, the adjustment of the various parameters by the user in a first stage is very difficult and, in any case, never takes real physical parameters of the sounding-board into consideration, so that, as the document itself points out, utterly fanciful results can be obtained.

In this context, the invention aims to propose a device for digital simulation, in real time, of sounds of an instrument having a keyboard and having strings that are linked to a sounding-board, such as a piano, with which the user (i.e. the instrumentalist) can choose and modify easily and quickly the sonority of the sounds produced. In particular, the invention aims to enable the user to define, according to intuitive criteria, any instrument sonority, the device producing—for each of the sonorities thus defined—sounds, the timbre of which bears the distinctive character of this sonority.

In particular, the invention aims to propose such a device enabling a user to define, quickly and easily, any sonority corresponding to any instrument whatever, which may be a known real instrument of traditional construction, as well as an instrument having physical characteristics that are determined directly by the user, or even a totally virtual instrument, unattainable in reality, capable of reproducing such a sonority.

In particular, the invention also aims to enable the user to define, notably in intuitive manner, new instrument timbres, in particular timbres corresponding to instruments, the construction of which would be unattainable in practice by reason of the mechanical constraints in this field, notably constraints linked to the physical properties of the materials, constraints linked to the known construction techniques, constraints of an economic nature etc.

The invention also aims to provide a device enabling the simulation of a wide range of instruments by enabling a user to act directly, simply and quickly on the physical parameters of the instrument to be simulated that in reality are likely to influence the timbre.

The invention also aims to provide the instrumentalist with a comfort of playing equivalent to that of traditional acoustic pianos, or at least approaching such a comfort of playing. In particular, the invention aims to provide a solution giving a response delay that is barely perceptible, or imperceptible, between each action of the instrumentalist and the corresponding sound-effect.

For this reason, the invention aims to provide a solution that is compatible with the computing power and the memory space exhibited by the known computers currently on the market, at a price that is affordable for the general public. In particular, the invention aims to produce sounds in real time on a personal computer that is commercially available at low cost, while showing consideration for the rhythm of a fast musical score.

The invention also aims to provide a solution obtaining high quality and good acoustic results while having an economical cost price.

In addition, there is a need to solve the aforementioned problems for keyboard instruments other than the piano, equipped with strings that are linked to a sounding-board. In order to do this, the invention relates to a device for production, by digital means, of signals that are representative of sounds having a sonority simulating that of a instrument having a keyboard and having strings that are linked to a sounding-board of the instrument, these sounds each corresponding to a note of the instrument, characterised in that said device includes:

- at least one presynthesis module adapted to produce timbre coefficients that are representative at least of the damping and/or of the frequency of each exponentially damped sinusoidal signal, known as a partial, composing a sound, starting from physical parameters including:
  - at least one physical parameter, known as the sounding-board parameter, that is characteristic of a sounding-board of the instrument to be simulated and representative of a measurable physical property of this sounding-board having an influence on the timbre of the sounds produced by the instrument,
  - at least one physical parameter, known as the string(s) parameter, that is characteristic of at least one string of the instrument to be simulated and representative of a measurable physical property of string(s) having an influence on the timbre of the sounds produced by the instrument,
- at least one module for production, in real time, of sounds by digital means, adapted to produce, in accordance with the timbre coefficients produced by the presynthesis module(s) and starting from at least one triggering signal relating to the playing of an instrumentalist, at least one signal that is representative of a sound composed at least of a plurality of partials.

A device according to the invention advantageously includes, in addition, means for capture, by a user, of at least one physical parameter, said presynthesis module being adapted to produce the timbre coefficients starting from the captured physical parameters. In order to facilitate this data capture, nothing prevents determining and recording sets of physical parameters during the manufacture of a device according to the invention, these predetermined sets, recorded beforehand, being capable of being used by the user for the capture of the physical parameters with a view to determination of the timbre coefficients by a presynthesis module.

Said measurable physical (sounding-board and/or string(s)) properties correspond to measurable properties that do not enable the acoustic behaviour or the sound provided to be evaluated without solving equations; in particular, it is not a question of characteristics of a sound provided by a real stringed keyboard instrument to be simulated, nor of the acoustic behaviour of a real stringed keyboard instrument to be simulated. It is a question, on the contrary, of measurable physical properties in which the maker of the instrument and/or the tuner of the instrument could intervene physically in the case of a real stringed keyboard instrument.

The physical sounding-board parameters and string(s) parameters condition the physical characteristics of the stringed keyboard instrument to be simulated and are independent of the simulation device (the values of these physical parameters being predetermined, or determined or modified by a data capture carried out by the user, constituting input values of the presynthesis module, and not being modified by subsequent digital processing), each of these physical parameters being capable of being modified independently of the others, in order to obtain a corresponding modification of the sounds produced.

In this way, the invention makes it possible to define, notably in intuitive manner, various sonorities of stringed keyboard instruments, and to produce realistic sounds corresponding to these various sonorities.

The inventor has been able to utilise devices according to the invention that are adapted to be able to reproduce, with a high degree of fidelity, the characteristic sonority of any mechanical real stringed keyboard instrument of traditional construction. However, no known prior device for production of sounds in real time enables such a result to be obtained by proceeding from physical sounding-board parameters and string(s) parameters.

Moreover, the invention enables the user to capture values of said physical parameters that do not necessarily correspond to those of a real instrument and that may extend to extreme values not encountered in reality (for example, exaggeratedly significant dimensions—or, on the contrary, exaggeratedly small dimensions—of the sounding-board), or even to fanciful values that are not technically attainable in practice (quadratic term equal to zero, several strings for the low frequencies, dimensions of the sounding-board normally incompatible with the tensile strength of the strings etc.). In this way, the invention enables sonorities of virtual instruments to be endlessly explored.

In particular, the inventor has established that for the operation of the presynthesis module it is possible in practice to use a mechanical modelling of the stringed keyboard instrument to be simulated that describes each string, the sounding-board and the coupling of the totality of the strings and of the sounding-board of the stringed keyboard instrument.

In this connection it should be noted that the invention goes against the earlier prejudice, according to which the mechanical modellings that are compatible with processing in real time should necessarily be simplified and would then be too approximate to make it possible to produce, in real time, sounds of stringed keyboard instruments exhibiting a high degree of realism or reproducing, with a high degree of fidelity, the sonority of a known stringed keyboard instrument of traditional construction.

In addition, according to this same prejudice it is known that the least approximate modellings do not make it possible to utilise a device for production of sounds of a stringed keyboard instrument in real time, and require a computing power considerably greater than that of current computers. In addition, according to this same prejudice it is estimated that the quality of the sounds produced according to such models depends, in very large measure, on the precision of the mechanical modelling, so that it was presumed that any imprecision in this connection would lead to a crippling loss in terms of quality of the sounds produced.

Conversely, the inventor has established that, in reality, a device according to the invention may have a modest memory capacity in comparison with the known devices, proceeding from prerecorded sounds of stringed keyboard instruments, in particular of a piano.

The aforementioned mechanical modelling which is used for the presynthesis module of a device according to the invention can be used for any stringed keyboard instrument, such as the piano, the pantalon, the harpsichord, the clavichord, the fortepiano etc. The aforementioned prejudice is particularly directed towards the mechanical models of pianos. Indeed, the sonority of the piano is particularly rich, and difficult to reproduce with precision. This mechanical modelling enables, in a device according to the invention, sets of values of coefficients of stored distinct timbres, in particular stored in the form of a table, to be calculated in association with sets of corresponding values for the various physical parameters that the user can modify. In this way, an initial configuration of the presynthesis module is realised, so that the determination of the timbre coefficients with each modification of a physical parameter by the user can be realised by the presynthesis module directly by interpolation, starting from prerecorded values for these timbre coefficients.

Advantageously, and according to the invention, the string parameter(s) is/are distinct from the sounding-board parameter(s).

Advantageously, and according to the invention, the device includes means for capture of at least one sounding-board parameter.

Advantageously, and according to the invention, the device includes means for capture of at least one string(s) parameter.

Advantageously, and according to the invention, at least one strings parameter is representative of a deviation in tuning between at least two coupled strings corresponding to the note.

The inventor has been able to obtain realistic piano sounds by taking account of the mutual influence of the strings of a set of coupled strings corresponding to the piano note.

Advantageously, and according to the invention, at least one sounding-board parameter is representative of at least one property of the material of the sounding-board.

In particular, a sounding-board parameter may be a weighting factor of the values of the Hooke tensor of the sounding-board, or even a dimension of the sounding-board.

Advantageously, and according to the invention, the physical parameters include, for a plurality of frequencies, at least one sounding-board parameter that is representative of the impedance of the sounding-board of the stringed keyboard instrument for each of these frequencies.

Advantageously, and according to the invention:

the device is adapted to produce sounds corresponding to a plurality of notes of a stringed keyboard instrument, the physical parameters may include, for each note of a stringed keyboard instrument, at least one sounding-board parameter that is representative of the impedance of the sounding-board of the stringed keyboard instrument for each frequency of a plurality of frequencies associated with said note of a stringed keyboard instrument.

In particular, the physical parameters may include a sounding-board parameter that is representative of the impedance of the sounding-board for each frequency of a plurality of frequencies, to each of which there corresponds at least one partial of the note.

Advantageously, and according to the invention, the device includes manual data-capture means.

Advantageously, and according to the invention, the presynthesis module is adapted to determine, starting from captured values of said physical parameters, the values of a plurality of modal elements including, besides said timbre coefficients, parameters of modal displacements that are representative of the fundamental modes of the coupled system of the sounding-board and the strings.

Moreover, advantageously, and according to the invention, the presynthesis module is adapted to determine the values of the modal elements starting from a constellation of points stored beforehand, each associating a set of values of the physical parameters that are capable of being captured by a user with a set of modal elements.

In addition, advantageously, and according to the invention, the values of the modal elements of each point are determined beforehand in accordance with a mechanical modelling of the instrument that takes account of the coupling of the strings and of the sounding-board. Advantageously, and according to the invention, said mechanical modelling takes account of deviations in tuning between the unison strings of the notes.

Moreover, advantageously, and according to the invention, the presynthesis module is adapted to determine excitation parameters that are representative of the initial amplitude $a_n(p)$ and of the phase difference $\theta_n(p)$ of each partial n of the note p.

Advantageously, and according to the invention, the presynthesis module is adapted to perform at least one presynthesis process as a background task, i.e. not in real time. In this way, the timbre coefficients are determined by the presynthesis module by a process that is not a real-time process and that does not therefore affect the effectiveness and the performance of the real-time module for production of sounds.

Advantageously, and according to the invention, each triggering signal is formed by a message relating to actions of an instrumentalist on keys of a keyboard—in particular a MIDI message. These triggering messages may be present in any format other than the MIDI standard.

Moreover, advantageously, and according to the invention, the production module realises, in real time, the synthesis of a signal that is representative of a piano sound as a function of the values of the timbre coefficients and of the excitation parameters corresponding to a note p to be produced and to an intensity of striking of this note p, such as have been determined by a received triggering signal.

Advantageously, a device according to the invention includes a data-processing system incorporating software for synthesis of sounds simulating the sonority of a keyboard instrument, strings and sounding-board, this software for synthesis of sounds forming each presynthesis module and each module for production of sounds in real time, and exhibiting a suitable man/machine interface to enable a user to form triggering signals and to present said means for capture of at least one physical parameter. In one embodiment, the instrument to be simulated being a piano, a device according to the invention includes at least one electronic keyboard with mechanical piano keys. In a variant, this digital keyboard can be simulated by the virtual man/machine interface of the data-processing system.

Advantageously, in a variant of the invention said data-capture means include means adapted to enable the user to modify, prior to its use by the module for production in real time, at least one timbre coefficient $f_n$, $d_n$ and/or at least one excitation parameter $a_n$, $\theta_n$, determined by the presynthesis module. In this way, the user can modify one and/or other of these coefficients or parameters in accordance with simple laws.

The invention extends to a recording medium—in particular of the removable type (CD-ROM, DVD, USB key, external electronic hard disk etc.)—adapted to be capable of being read in a reader of a data-processing device and including a recorded computer program adapted to be capable of being loaded into the random-access memory of said data-processing device when this recording medium is loaded in said reader, characterised in that this computer program is adapted so that, when it is loaded in the random-access memory of this data-processing device, this latter constitutes a device for production, by digital means, of signals that are representative of sounds, according to the invention.

The invention also relates to a device and to a recording medium that are characterised, in combination, by all or some of the characteristics mentioned above or below.

Figure 2:
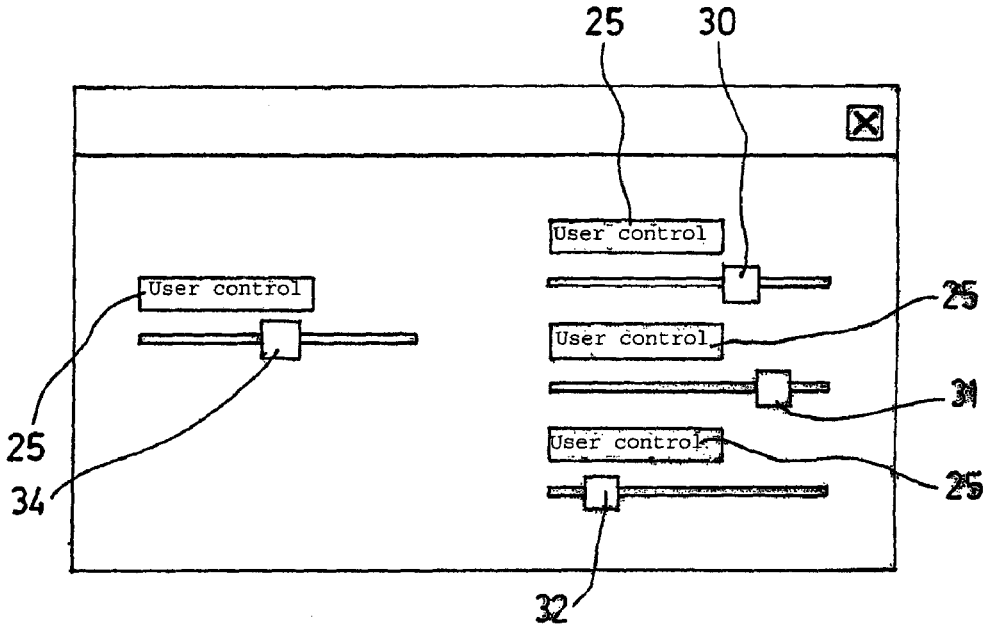
Figure 3:
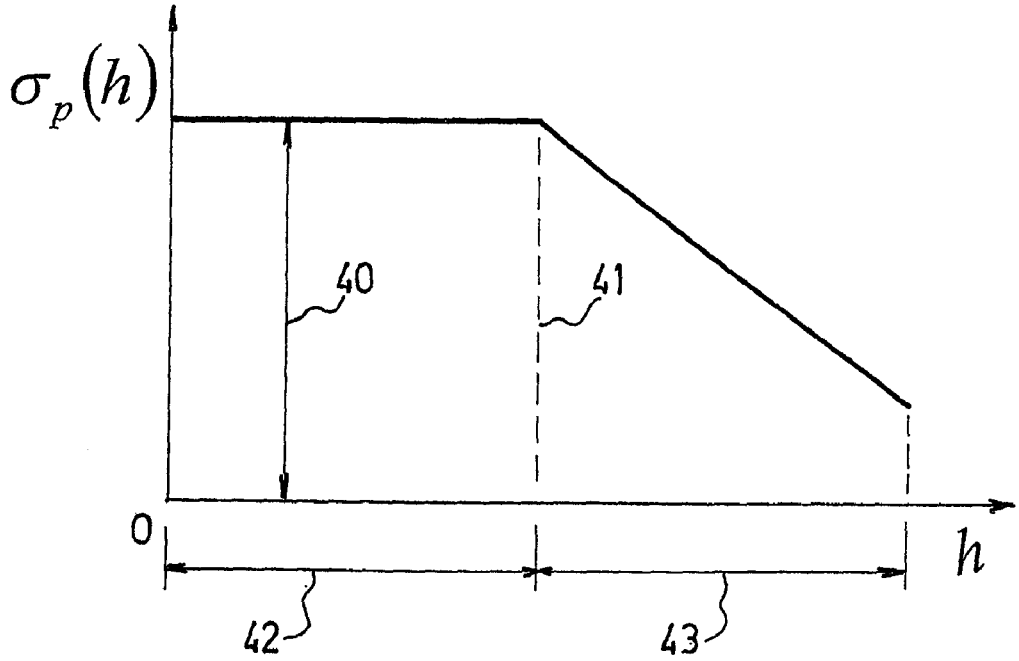
Figure 4:
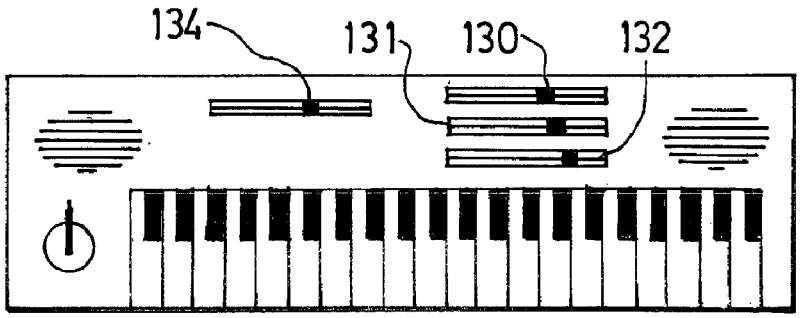
Figure 5:
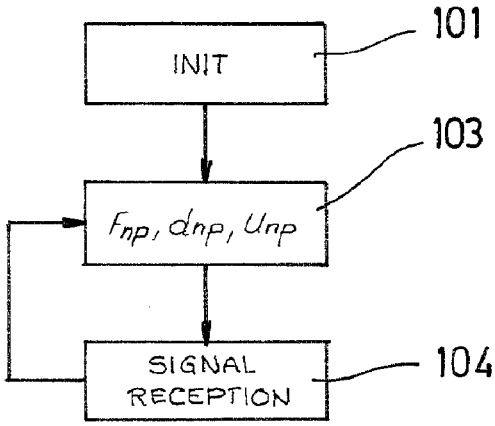
Figure 6:
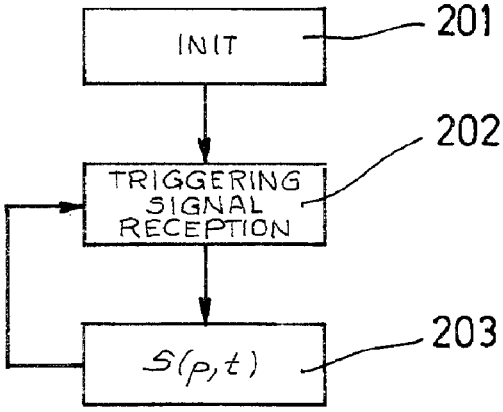
Figure 7:
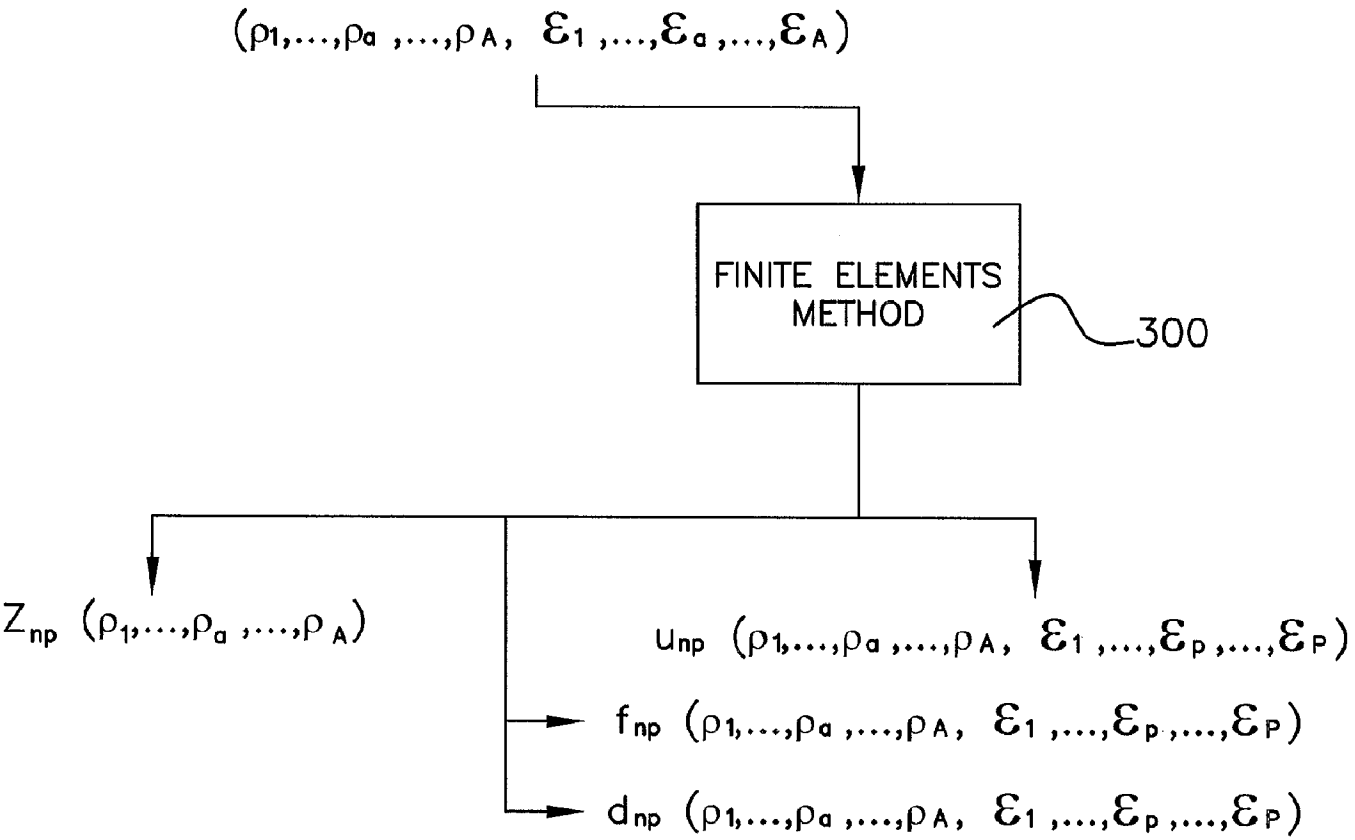
Figure 8:
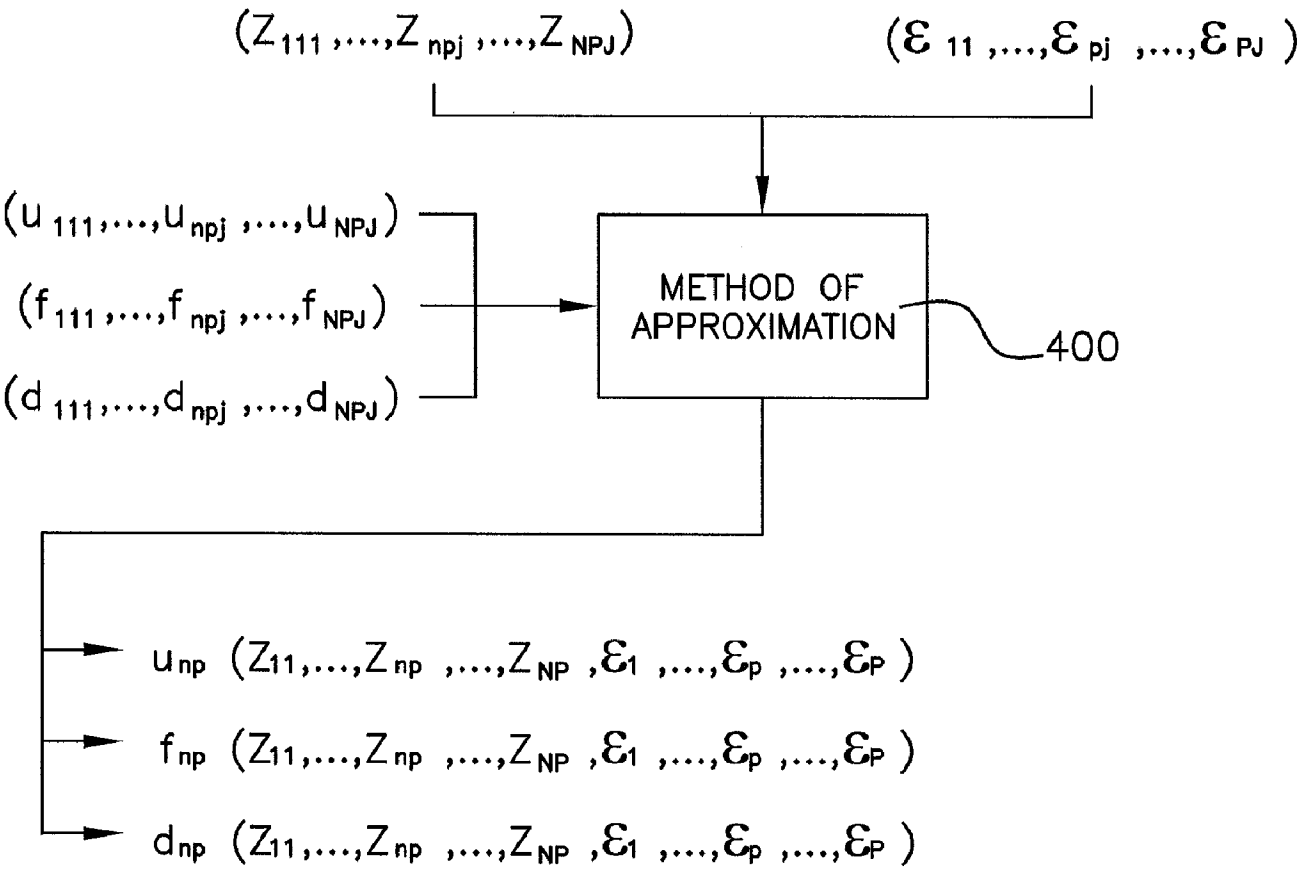

Other characteristics, objectives and advantages of the invention will become apparent on reading the following description, which refers to the appended Figures, in which:

FIG. 1 is a schematic representation of a device according to a first example of implementation of the invention, FIG. 2 represents a graphics interface of software, known as software for synthesis of piano sounds, running within a microcomputer of the device shown in FIG. 1, FIG. 3 is a graph illustrating a weighting function, FIG. 4 is a schematic representation of a device according to a second example of implementation of the invention, FIG. 5 represents an algorithmic diagram according to which a presynthesis module runs within the microcomputer shown in FIG. 1, FIG. 6 represents an algorithmic diagram according to which a module for production of sounds in real time runs within the microcomputer shown in FIG. 1, FIG. 7 illustrates an implementation of the method of finite elements that is capable of being used in a presynthesis module according to the invention, FIG. 8 illustrates an implementation of a method of approximation that is capable of being used in a presynthesis module according to the invention.

In a first example of implementation of the invention, software for synthesis of piano sounds is recorded in the form of one or more files in a bulk memory 1 of a data-processing system such as a microcomputer 2 of the personal-computer type, also known as a PC. The bulk memory is adapted to be able to transmit, through a data bus 3, the executable data corresponding to these backup files to a processing unit 4 including at least one processor 5 and an associated random-access memory 6. Such a transmission of the data to the processing unit 4 can be effected in traditional manner by having recourse to system functions of an operating system 7 which is loaded in random-access memory and which runs by means of the processing unit 4 of the microcomputer 2.

According to the first example of implementation of the invention, the operating system 7 includes software drivers adapted to enable the use of peripherals with which the microcomputer 2 is equipped. These peripherals include, in particular, a graphics card 8 and its associated monitor 9, an alphanumeric keyboard 10, a mouse 11, a MIDI interface 12, the bulk memory 1 and an audio card 13. This microcomputer 2 includes, in addition, ports and data input/output controllers, buses and interfaces enabling communication between the aforementioned peripherals and the processing unit 4.

According to the first example of implementation of the invention, the device includes, in addition, an audio amplifier 14 to which the audio card 13 of the microcomputer 2 is connected by means of a cable 15 for transmission of an audio signal. This amplifier is itself connected to at least one loudspeaker 16 to which it transmits an amplified audio signal with a view to expressing this signal in the form of audible sounds.

According to the first example of implementation of the invention, the device includes, in addition, a keyboard, known as the MIDI keyboard 17, including a port, known as the MIDI OUT interface, for connection with a view to the transmission of messages, known as MIDI messages, according to the standard designated as Musical Instrument Digital Interface (MIDI). These MIDI messages are representative of events, detected by the keyboard 17, produced subsequent to actions of the user on keys 23 or by means of control switches 33 of the MIDI keyboard 17. In particular, MIDI messages, known as musical-performance MIDI messages, relating to the playing of the instrumentalist (triggering of a note, speed of depression of the corresponding key, release of a note, actuation of a pedal etc.) are detected, in particular, in the course of actions of the instrumentalist on keys 23 of the keyboard.

The MIDI OUT interface is connected by means of a suitable cable, known as the MIDI cable, to an input port, known as the MIDI IN, of the MIDI interface 12 of the microcomputer. In this way, the MIDI messages produced by the keyboard can be transmitted to the processing unit 4.

The software for synthesis of piano sounds is adapted to interpret any received musical-performance MIDI message and to produce audio signals in a digital format. The signals produced are transmitted in the direction of the audio card, the amplifier and at least one associated loudspeaker (or headphones) with a view to production of audible piano sounds in real time.

In this example of implementation of the invention, the musical-performance MIDI messages that are generated and transmitted by the MIDI keyboard to the processing unit form triggering signals relating to the playing of an instrumentalist and enabling, with the aid of the device according to the invention, audio signals to be produced that are representative of sounds corresponding to this playing. Of course, these musical-performance messages that are representative of a manner of playing of an instrumentalist may be present in any format other than the MIDI standard. In practice, the triggering signals must be representative at least of the principal frequency of a note and its duration and, preferably, also its intensity (or velocity).

The audio signals are each obtained by effecting the sum of exponentially damped sinusoidal signals, known as partials, and of a percussion signal. Each of the partials (identified by index n) is defined by two coefficients: the frequency, known as frequency $f_n$, and the damping coefficient, known as coefficient $d_n$, which form the timbre coefficients according to the invention. In practice, each note p of the piano to be simulated is associated, in the software for synthesis of piano sounds, with a set of timbre coefficients defining a plurality of partials.

Each note p may correspond to a string or to several strings, known as unison strings. It should be noted that for a note p comprising K unison strings (K being a whole number equal to or greater than 1) there exist K partials n for each harmonic of the note p. By way of example, for a note La, the fundamental of which is at 440 Hz and which is provided with 3 strings, there exist 3 modes corresponding to 3 partials, the frequencies of which are close to 440 Hz, 3 modes corresponding to 3 partials, the frequencies of which are close to 880 Hz, etc.

It should be noted that the term 'harmonic' has to be interpreted as designating the mode of vibration of the system formed by the coupling of the sounding-board and the strings of the corresponding note p. In this connection, bearing in mind the inharmonicity, this term designates modes of vibration, the frequency of which is not necessarily an integral multiple of that of the fundamental mode.

In the first example of implementation of the invention, the audio signal corresponding to a piano note p that has been played is produced as a function of the timbre coefficients and in accordance with parameters of triggering of the note p (intensity of striking of the string, in particular) as determined in accordance with a musical-performance MIDI message. The audio signal that is produced can be represented in accordance with the following formula (1), which is valid for one or more audio channels:

$$s(p,t)=\sum_n a_n(p)\exp(-d_n(p)t)\sin\begin{pmatrix}2\pi f_n(p)t+\\ \partial_n(p)\end{pmatrix}+b(p,t) \quad (1)$$

where:

t represents the time, p is a triggering signal identifying the note p and including at least the pitch of this note p and possibly the velocity and/or the duration of the note p, s(p,t) represents the audio signal produced, $d_n(p)$ represents the damping coefficient of a partial n corresponding to the note p, $f_n(p)$ represents the frequency of each partial n corresponding to the note p, $a_n(p)$ represents the initial amplitude of the partial n of the note p directly after the impact of the hammer on the strings of the note p, $\theta_n(p)$ represents the phase difference of the partial n from the note p, b(p,t) represents the percussive part of the sound (impact of the hammer on the strings, the structure) and any other component of the piano sound that cannot be modelled (or that can only be poorly modelled) by a decomposition into a sum of sines.

The quantity s may be a vector quantity, each component corresponding to an audio output channel. Because of this, the quantities $a_n$, $\theta_n$ and $b_n$ are also vectorial. Associated with each component of s is the corresponding component of $a_n$, $\theta_n$ and $b_n$.

In such a representation, the resonator corresponds to the coefficients $d_n(p)$ and $f_n(p)$, and the exciter corresponds to the coefficients $a_n(p)$ and $\theta_n(p)$. The resonator is the operator associated with the model, its eigenvalues determining $d_n(p)$ and $f_n(p)$. The exciter is the second member of the associated mechanical system, the coefficients of the solution of this system in the base of fundamental modes determining $a_n(p)$ and $\theta_n(p)$.

The aforementioned formula (1) can be expressed in the following equivalent form:

$$s(p,t)=\mathrm{real}\left(\sum_n \alpha_n(p)\exp(2\pi i f_n(p)t-d_n(p)t)\right)+b(p,t) \quad (2)$$

where $$\alpha_n(p)=-ia_n(p)\exp(i\theta_n(p)) \quad (3)$$

The software for synthesis of piano sounds is adapted to determine the values of the timbre coefficients for the totality of the notes of the piano in accordance with physical parameters that are representative of measurable quantifiable physical properties of the instrument having an influence on the timbre of the sounds produced by a corresponding real instrument but not enabling the acoustic behaviour or the sound provided to be evaluated without solving equations.

The physical parameters advantageously include parameters of the sounding-board and in particular parameters known as impedance parameters, each one representative of the impedance $Z_{np}$ that the piano sounding-board exhibits for a partial n of a piano note p.

In addition, the physical parameters advantageously include string(s) parameters and in particular parameters known as tuning parameters, each one representative of a deviation in tuning $\epsilon_p$ between a plurality of coupled piano strings corresponding to the note p.

The device according to the invention is adapted to enable a capture by the user (i.e. by the instrumentalist) of the physical parameters, so that a modification of the values $d_n(p)$ and $f_n(p)$ (notes $d_{np}$ and $f_{np}$ in FIGS. 7 and 8) of the timbre coefficients results therefrom and, in consequence, a modification of the timbre of the sounds produced. Of course, the modification of the timbre of the sounds produced must correspond to the modification of the physical parameters captured by the user.

In practice, the software for synthesis of piano sounds includes a module, known as the presynthesis module 19, that is capable of determining the values to be assigned to the timbre coefficients as a function of the physical parameters in accordance with a function, known as the interpolation function. In the first example of implementation of the invention, the interpolation function enables the values of a plurality of modal elements to be determined from captured values of the physical parameters. In this example, the modal elements include the timbre coefficients and modal displacements, representative of the fundamental modes, known as the $u_{np}$ modes, of the coupled system of the sounding-board and the strings. Each of these modes $u_{np}$ corresponds to a partial n of the note p. This interpolation function is constructed prior to the realisation of the device according to the invention of this example by means of a computer, starting from a constellation of points each associating a set of values $Z_{np}$, $\epsilon_p$ of the physical parameters with a set of values, $f_{np}$, $d_{np}$, $u_{np}$ of the modal elements. In order to do this, said computer generates digital coefficients defining this interpolation function.

For the construction of the interpolation function, use may be made of polynomial functions with several variables, radial basis functions etc. The construction of the constellation of points is based on techniques known as such, such as Latin hypercubes, space-filling or the technique of sparse grids. A linear regression function may also be considered. In a preferred variant, the successive derivatives of the modal elements with respect to said physical parameters are calculated for the construction of a Taylor polynomial or of a Padé approximant with several variables. The constellation of points is then replaced by a constellation of directions of derivation.

In the first example of implementation of the invention, the values of the modal elements of each point are determined prior to the execution of the method of approximation in accordance with a mechanical modelling of the piano, starting from the physical parameters of this latter and in particular from the values captured by the user. This mechanical modelling is implemented in accordance with a method of digital analysis. The method of digital analysis can be performed by a computer (not represented in the Figures).

By way of example, a method of finite elements may be implemented in order to model the sounding-board and the strings of a piano with a view to determining the dynamic behaviour of the system formed by the sounding-board and the strings so as to determine its complex resonance frequencies ($f_{np}+id_{np}/2\pi$) as well as the so-called fundamental modes $u_{np}$ of the coupled system of the sounding-board and the strings. In this connection, publication PH. GUILLAUME, Nonlinear eigenproblems, SIAM J. Matrix Anal. Appl. Vol.

20 No. 3 (1999), 575-595, describes a process for calculation of the complex eigenvalues of a system with non-linear eigenvalues, which can be used in the present invention.

Matrices of mass, rigidity and damping that are necessary for the implementation of the method of finite elements are established in accordance with a piano model to be simulated.

In particular, these matrices are determined as a function of parameters, known as piano-modelling parameters, from this piano model to be simulated.

According to the piano model of the first example of implementation of the invention, each note p corresponds to one or more unison strings on which there strikes a hammer corresponding to this note. In accordance with the rules of the art as regards construction of modern pianos, some low notes of the piano to be simulated may comprise one or two unison strings, whereas the other notes may comprise three unison strings.

In the first example, the piano-modelling parameters include the parameter $\epsilon_p$ for deviation in tuning between the unison strings of the note p. In practice, this parameter may correspond to a weighting factor, known as the tuning factor, that is representative of a deviation in tuning between several strings of the note. By way of illustrative example, in the case where three strings are associated with the note the tensions of these strings can be determined in accordance with the following formulae (3) and (4):

$$T_2=\epsilon_p T_1 \quad (4)$$

$$T_3=(2-\epsilon_p)T_1 \quad (5)$$

where:

$\epsilon_p$ represents the value of the tuning factor, this value being a positive real number less than unity, $T_1$ is representative of the tension of a first string, the tuning of which is such that the fundamental mode of vibration of this string corresponds to the fundamental frequency of the corresponding note p, as determined in accordance with a predetermined temperament of the piano to be simulated, $T_2$ is representative of the tension of a second string, the tuning of which is such that the fundamental mode of vibration of this string is of higher frequency than the fundamental frequency of the corresponding note p, $T_3$ is representative of the tension of a third string, the tuning of which is such that the fundamental mode of vibration of this string is of lower frequency than the fundamental frequency of the corresponding note p. In addition, the piano-modelling parameters of the first example of implementation of the invention include at least one sounding-board-modelling parameter. In particular, a weighting factor of the values of the Hooke tensor of the sounding-board may constitute a sounding-board-modelling parameter.

In the first example of implementation of the invention, the matrices of mass, rigidity and damping are established in accordance with the dimensions and the structure of the strings and of the sounding-board and also of the Hooke tensor of these elements of the piano, as determined in accordance with the model of the piano to be simulated and the values of the piano-modelling parameters.

The method of finite elements is implemented in order to determine, for each note p of the piano to be simulated, an impedance value $Z_{np}$ of the sounding-board for each partial n of the note p. These sounding-board impedance values $Z_{np}$ are representative of physical properties of the sounding-board.

The piano model of the first example of implementation of the invention is a model close to reality.

In particular, each string of the piano can be modelled as an elastic beam. The inventor has been able to ascertain that the use of such a model makes it possible to express the inharmonicity effect occurring by reason of the non-negligible rigidity of the string in flexion, as well as the quadratic effect due to the interaction with the wippen. This latter sound-effect is all the more perceptible, since the amplitude of vibration of the string is significant, and therefore the notes are played strongly.

In addition, in the modelling used in the first example of implementation of the invention each string is considered as being embedded in the region of the point of fastening and of the nut. This point of fastening and the nut may be considered to be totally immobile, so that the position of the string in the region of the nut and the position of the string in the region of the point of fastening form, in the model of the first example, boundary conditions of the string. Moreover, each string is considered as being rigidly linked with the wippen of the sounding-board by means of the wippen points in conformity with the rules of the art as regards piano construction.

In this way, this modelling takes account of the coupling of the strings of the piano and the sounding-board. This coupling is obtained, in the pianos of traditional construction, in the region of the wippen by reason of a forcing of the position of each string at this place. The model makes it possible to take account of the mutual influence of the strings of the piano, notably the phenomenon of resonance by virtue of sympathy between the notes and the mutual influence of the unison strings of the same note. The inventor has been able to ascertain that the taking into account, in the modelling, of this coupling of the strings and the sounding-board, as well as the deviations in tuning between the unison strings of the notes, enables a device to be obtained producing realistic piano sounds.

A shell model may be employed, in order to represent the sounding-board, including the nut and the wippen of this sounding-board, by means of finite elements. A laminar model of order 1 may, in addition, be used in order to take account of the orientation of the fibre of the sounding-board with reinforcements in the orthogonal direction.

The sounding-board may also be modelled by an isotropic material with an addition of reinforcements in the direction of the fibre and in the orthogonal direction. Lastly, use may be made of a model in three dimensions, known as a 3D model, which may or may not be isotropic.

The method of finite elements is implemented several times, varying, after each stage of analysis (iteration), the value of at least one piano-modelling parameter in such a way as to modify the physical properties of the piano. The matrices of the method of finite elements are consequently redefined after each of the stages of analysis. A plurality of points that are representative of various mechanical piano configurations (as defined by the values $Z_{np}$, $\epsilon_p$ of the physical parameters) and of the corresponding acoustic behaviour (as defined by the values $f_{np}$, $d_{np}$ of the timbre coefficients obtained from the values $Z_{np}$, $\epsilon_p$ of the physical parameters) are thus determined.

The method of finite elements is repeated a large number of times. It is a question of providing a number of distinct points making it possible to define the interpolation function with sufficient precision so that it makes it possible to obtain, starting from a set of values $Z_{np}$, $\epsilon_p$ of the physical parameters, which correspond to the values capable of being captured by the user, values $f_{np}$, $d_{np}$, $u_{np}$ of the modal elements that are representative of the mechanical configuration corresponding to these values of the physical parameters. The totality of these associated values is determined by preliminary calculations, and their values and their correspondences are used by an interpolation process of the presynthesis module.

FIG. 7 illustrates an implementation of the method of finite elements that is capable of being used in order to realise a presynthesis module according to the invention.

In this Figure, a process implementing the method is represented by a schematic block 300 receiving at its input the values $p_1, \ldots, p_a, \ldots, p_A, \epsilon_1, \ldots, \epsilon_p, \ldots, \epsilon_P$ of the piano-modelling parameters and producing, for each partial n of each note p, the corresponding values $u_{np}$, $f_{np}$, $d_{np}$ of the modal elements as well as the corresponding values $Z_{np}$ of the impedance parameters. In FIG. 7:

- $p_a$ represents a sounding-board-modelling parameter identified by the index a, for example the weighting factor of the values of the Hooke tensor of the sounding-board,
- A represents the number of sounding-board-modelling parameters,
- $\epsilon_p$ represents the deviation in tuning of a note p of the sounding-board.
- P represents the number of notes of the piano to be simulated,
- N represents the number of partials per note,
- $Z_{np}$ represents the impedance parameter corresponding to the partial n of the note p,
- $u_{np}$ represents the fundamental mode of the partial n of the note p.

The process defined by FIG. 7 is performed on a high-power computer which is not represented. These calculations are effected beforehand and not in real time; their results are recorded in a bulk memory which is accessible to the module for production of the sounds, so that this module for production of the sounds is able to generate sounds of stringed keyboard instruments in real time.

FIG. 8 illustrates the implementation of a method of approximation that is capable of being used in order to realise a presynthesis module according to the invention. In this Figure, a process implementing the method of approximation is represented by a schematic block 400 which receives at its input the values $Z_{111}, \ldots, Z_{npj}, \ldots, Z_{NPJ}, \epsilon_{11}, \ldots, \epsilon_{pj}, \ldots \epsilon_{PJ}$ of the physical parameters and which produces a function making it possible to determine the corresponding values $u_{np}$, $f_{np}$, $d_{np}$, of the modal elements corresponding to each partial n of each note p. In FIG. 8:

- j is an index identifying a point obtained in the course of a corresponding stage of analysis of the method of finite elements,
- J represents the number of points obtained by means of the method of finite elements,
- P represents the number of notes of the piano to be simulated.

In practice, the interpolation function can be determined by means of a kriging technique, by means of neural networks, by means of a support vector machine, known as an SVM, by means of a radial basis function, known as an RBF, or by means of any suitable interpolation.

In an alternative, the technique of successive derivatives may be implemented (cf. PH. GUILLAUME, M. MASMOUDI, Solution to the time-harmonic Maxwell's equations in a waveguide, use of higher order derivatives for solving the discrete problem, SIAM Journal on Numerical Analysis, 34-4 (1997), 1306-1330—PH. GUILLAUME, Nonlinear eigenproblems, SIAM J. Matrix Anal. Appl. Vol. 20 No. 3 (1999), 575-595—J. D. BELEY, C. BROUDISCOU, PH. GUILLAUME, M. MASMOUDI, F. THEVENON, Application de la Methode de Dérivées d'Ordre Elevé à l'Optimisation des Structures, REVUE EUROPEENNE DES ELEMENTS FINIS, 5 (1996), 537-567—M. MASMOUDI and PH. GUILLAUME, Sensitivity Computation and Automatic Differentiation, Control and Cybernetics, 25 (1996) No 5, 831-866—M. MASMOUDI, PH. GUILLAUME and C. BROUDISCOU, Automatic differentiation and shape optimization, J. Herskovitz (ed.), Advances in Structural Optimization, 413-446, Kluwer Academic Publishers, Printed in the Netherlands, 1995—PH. GUILLAUME, M. MASMOUDI, Computation of high order derivatives in optimal shape design, Numerische Mathematik, Vol. 67 No. 2 (1994), 231-250, 1994—PH. GUILLAUME, M. MASMOUDI, Calcul numérique des dérivées d'ordre supérieur en conception optimale de formes, C.R. Acad. Sci. Paris, Vol. 316 Series I (1993), 1091-1096—PH. GUILLAUME, M. MASMOUDI, Derivées d'ordre supérieur en optimisation de domaines, C.R. Acad. Sci. Paris, Vol. 315 Series I (1992), 859-862—C. BROUDISCOU, M. MASMOUDI and PH. GUILLAUME, Application of automatic differentiation to Optimal Shape Design, J. Herskovitz (ed.), Advances in Structural Optimization, 413-446, Kluwer Academic Publishers, Printed in the Netherlands, 1995). In accordance with this method, a calculation of the successive derivatives of the timbre coefficients with respect to the physical parameters can be realised for a modelling of the piano according to the finite elements with a view to constructing a Taylor polynomial or a Padé approximant. Such a polynomial or such an approximant forms an interpolation function according to the invention.

In an alternative, the method of Padé, generalised to several variables, can be used as method of approximation (cf. PH. GUILLAUME, Nested Multivariate Padé Approximants, Journal of Computational and Applied Mathematics, 82 (1997), 149-158—PH. GUILLAUME, A. HUARD, V. ROBIN, Generalized Multivariate Padé Approximants, J. Approx. Theory, Vol. 95, No. 2 (1998), 203-214—PH. GUILLAUME, Convergence of the Nested Multivariate Padé Approximants, J. Approx. Theory, Vol. 94, No. 3 (1998), 455-466-PH. GUILLAUME, A. HUARD, Multivariate Padé approximation, Journal of Computational and Applied Mathematics 121 (2000), 197-219).

In addition, the points starting from which the method of approximation is implemented can be determined by any method other than the method of finite elements. In particular, any method can be used making it possible to determine the dynamic behaviour, the modes $u_{np}$ and the complex resonance frequencies. By way of example, the points can be determined by proceeding in accordance with spectral methods or using the principle of finite differences. In addition, equivalent circuits, lattices of beams or of equivalent bars, an analytic or spectral calculation, may be employed.

In a device according to the invention, a capture of physical parameters can be realised by the user by any means.

In the first example of implementation of the invention, such a data capture can be realised directly by the user starting from man/machine interface devices with which the microcomputer is equipped, in particular the screen 9 and the mouse 11. In practice, the software for synthesis of piano sounds of the first example of implementation of the invention is able to define a graphics interface which is displayed on the monitor 9 during the running of the software for synthesis of piano sounds. This interface includes a plurality of graphical elements representing knobs 30, 31, 32, 34, mounted on slides, identified by textual elements 25 for the attention of the user.

In the first example of implementation of the invention, the software for synthesis of piano sounds includes backup files defining, for each note p of the piano, the default values for the tuning parameters. The position of a knob 34 of the graphics interface of the first example of implementation of the invention makes it possible to determine the value of a weighting factor. The software for synthesis of piano sounds is adapted to multiply this weighting factor by each of the default values of the tuning parameters. The values resulting from this multiplication correspond to captured values $\epsilon_p$ of the tuning parameters with a view to determination of the values $u_{np}$, $d_{np}$, $f_{np}$ of the modal elements by means of the interpolation function.

In the first example of implementation of the invention, the capture of the impedance values $Z_{np}$ of the mechanical parameters is realised for each note p according to a function, known as the weighting function. This weighting function defines a weighting factor for each impedance value of a plurality of default impedance values, each one corresponding to a partial n of this note p. The position of graphics-interface knobs 30, 31, 32 of the first example of implementation of the invention enables the user to modify the weighting functions so that the impedance values obtained by weighting, in accordance with these functions, of the default impedance values correspond to captured values $Z_{np}$ of the impedance parameters. These captured values $Z_{np}$ are employed in order to determine the values $u_{np}$, $d_{np}$, $f_{np}$ of the modal elements by means of the interpolation function.

In practice, the default impedance values can be read by the software for synthesis of piano sounds in backup files. These default impedance values may be the values $Z_{npj}$ determined in the course of an analysis number j by the method of finite elements. In addition, the software for synthesis of piano sounds of the first example may include backup files defining, for each note p of the piano, the default values of parameters of the corresponding weighting function. Each weighting function defines a value of the weighting factor $\sigma_p(h)$ for each harmonic of the note p as a function of order h of the harmonic. The weighting factor $\sigma_p(h)$ thus defined for each harmonic is employed in order to weight the moduli of the default impedance values of the K partials of the note p corresponding to this harmonic.

Each weighting function may be a continuous affine function composed of two parts. FIG. 3 illustrates such a function having the weighting factor $\sigma_p(h)$ on the ordinate and the order h of the harmonics on the abscissa. A first constant part 42 defines a constant weighting factor for the low-order harmonics. A second part 43 defines a weighting factor decreasing with the order h of the high-order harmonics.

Each weighting function can be defined by means of three weighting-function parameters. A first parameter, known as the weighting constant 40, determines the value of the weighting factor for the low-order harmonics. A second parameter, known as the cut-off index 41, determines the order from which the weighting function becomes decreasing.

This index corresponds to the maximum order of the low-order harmonics. A third parameter, known as the quality factor, determines the slope of the second part 43 of the affine function.

Three knobs 30, 31, 32 of the graphics interface form means for capture of the parameters of the weighting functions of all the notes. In practice, the position of each knob in relation to its slide may be representative of a weighting factor to be applied to the default values of parameters of the weighting functions. In this way, each of the three knobs 30, 31, 32 makes it possible to modify, in a uniform or non-uniform way, the parameters of the weighting functions of the totality of the notes of the piano: the first knob 30 makes it possible to modify the weighting constants 40 of these functions, the second knob 31 makes it possible to modify the cut-off indices 41 of these functions, and the third knob 32 makes it possible to modify the quality factors of these functions.

The knobs 30, 31, 32 and 34 of the graphics interface, as well as the peripherals enabling their manipulation (in particular, the mouse 11, the keyboard 10 and the screen 9), form means for capture of physical parameters according to the invention.

In this way, the software for synthesis of piano sounds enables the user to effect modifications of the physical properties of the piano affecting, in a uniform or non-uniform way, a plurality of the notes of the piano by acting on a reduced number of data-capture means, such as the knobs 30, 31, 32 and 34 of the graphics interface.

Nothing prevents equipping the software for synthesis of piano sounds with means (such as the aforementioned knobs 30, 31, 32 and 34) for capture of the sounding-board parameters and of the strings parameters for each note p of the piano with a view to enabling the user to define the physical properties of the piano with more precision.

In addition, nothing prevents defining each weighting function in accordance with a greater number of weighting-function parameters with a view to enabling the user to define, with more precision, the physical properties of the sounding-board as a function of the orders of the harmonics of each note.

In addition, the weighting functions of the notes of the piano can be determined by any control means other than the knobs 30, 31, 32. By way of example, the graphics interface may include a graphical representation of each weighting function in the form of a continuous curve extending in a plane provided with an abscissa corresponding to the order h of the harmonics and with an ordinate corresponding to the weighting factor $\sigma_p(h)$. In practice, this curve may be of cubic-spline type, and the graphics interface may include graphical elements, known as handles, each one corresponding to a checkpoint of the cubic spline.

In an alternative, or in combination, manual control means 33 of the MIDI keyboard may be employed in order to generate MIDI messages corresponding to modifications to be made to the physical parameters, the software for synthesis of piano sounds then being adapted to interpret such MIDI messages and to realise a corresponding capture of the physical parameters. In this case, the control knobs 33 of the keyboard 17, the MIDI interface 12 and a software module (not represented) for interpretation of the MIDI messages corresponding to commands for capture of the physical parameters, form data-capture means of the device according to the invention.

In addition, in a variant, nothing prevents automatically effecting a sequence of modifications of the physical properties, for example by means of a MIDI software sequencer (not represented) running within the microcomputer 2 and adapted to transmit to the software for synthesis of piano sounds corresponding MIDI messages recorded beforehand in a backup file. It should be noted, moreover, that nothing prevents transmitting, by means of such a MIDI software sequencer, a sequence of musical-performance MIDI messages recorded beforehand in a backup file. The musical-performance MIDI messages transmitted in this way form triggering signals according to the invention.

The software for synthesis of piano sounds may be programmed in order to create, subsequent to its loading into memory, processes running within the processing unit 4 with other processes, notably system processes, in accordance with a scheduling, the management of which is ensured by the operating system 7.

The presynthesis module 19 performs a first process, known as the presynthesis process, adapted to provide the values $f_{np}$, $d_{np}$ of the timbre coefficients corresponding to values $\epsilon_p$, $Z_{np}$ of captured physical parameters. This presynthesis process does not run in real time but, on the contrary, as a background task.

FIG. 5 represents an algorithmic diagram, according to which the presynthesis process runs. Subsequent to its creation by the presynthesis module 19 of the software for synthesis of piano sounds, the presynthesis process is programmed in order to effect an initialisation stage 101 in which this process reads the backup files, the default values of the tuning parameters, the default impedance values, and the default values of the parameters of the weighting functions.

In a stage 103, subsequent to stage 101, the presynthesis process determines, as previously described, the values $f_{np}$, $d_{np}$, $u_{np}$ of the modal elements starting from the captured values $\epsilon_p$, $Z_{np}$ of the physical parameters, then records these values $f_{np}$, $d_{np}$, $u_{np}$ for the attention of the real-time process for production of the sounds. In practice, these data may be recorded in a data-transfer file that is accessible to the real-time process for production of the sounds, in such a way as to enable a recovery of these data by this latter process.

It should be noted that the interpolation function makes it possible to determine, with a slight calculation load, the values $f_{np}$, $d_{np}$, $u_{np}$ of the modal elements corresponding to the set of values of the physical parameters.

In addition, in stage 103 the presynthesis process processes, for each note p of the piano, a plurality of signals, known as exciting signals $E_{pI}(t)$, each one representative of the excitation of the strings of the note p according to an intensity of striking I of this note. In practice, these exciting signals can be measured directly on a piano of traditional construction by using an automatic and adjustable mechanical device for depression of the notes of the piano, these exciting signals being recorded in backup files. It should be noted in this connection that these exciting signals are never used as an audio signal in a device according to the invention.

From each of these exciting signals $E_{pI}(t)$ the presynthesis process determines the values of parameters, known as excitation parameters, that are representative of the initial amplitude $a_n(p)$ and of the phase difference $\theta_n(p)$ of each partial n of the note p. In practice, the presynthesis process processes each exciting signal $E_{pI}(t)$ according to the fundamental modes $u_{np}$ of the corresponding note p, in accordance with the modal method. At a given point x of the sounding-board the displacement u(x,t) decomposes into the following form:

$$u(x, t) = \mathrm{Re}\left(\sum_n \alpha_n \exp(2i\pi(f_n + id_n)t)\right) \tag{6}$$

where the $\alpha_n$ are provided by the formulae (1), (2) and (3) of the aforementioned modal analysis.

Each set of values of the excitation parameters $a_n(p)$ and $\theta_n(p)$ thus obtained for each note p is recorded for the attention of the production process in a table, according to which the sets of values are classified as a function of the intensity of striking I of the exciting signal $E_{pI}(t)$.

In a variant, the excitation parameters can be obtained in any other way, for example starting from a physical model that is representative of the string/hammer interaction.

In a stage 104, subsequent to stage 103, the presynthesis process is placed on stand-by for reception of a signal according to which at least one physical parameter has been captured. Such a signal can be transmitted to the presynthesis module subsequent to any displacement of one of the knobs 30, 31, 32, 34 of the graphics interface. Subsequent to the reception of such a control signal, the presynthesis process again performs stage 103 and the subsequent stages.

In the example, the presynthesis module thus determines new values of timbre coefficients and of excitation parameters upon each modification of a physical parameter as determined by a data capture by the user with the aid of the data-capture means (mouse, keyboard, graphics interface etc.) or by software transmitting corresponding signals (MIDI sequencer, for example) to a software module (not represented) for production of piano sounds, adapted to interpret the signals and to effect a corresponding capture of the physical parameters.

Subsequent to each recording of the values of the timbre coefficients effected in stage 103, and prior to placing itself in a position of stand-by according to stage 104, the presynthesis module is preferably adapted to transmit an interrupt to the module for production of sounds, in order to make known to it that new values of timbre coefficients and of excitation parameters are available.

The presynthesis process is preferably performed continuously until the software for synthesis of piano sounds signals to it to terminate.

The software for synthesis of piano sounds includes, in addition, a module 20 for production in real time, by digital means, of audio signals that are representative of the sounds. This real-time module 20 for production of sounds creates, in the random-access memory, at least one real-time process for production of the sounds as mentioned above, adapted to be able to read the values of the timbre coefficients and of the excitation parameters produced by the presynthesis process and to produce digital audio signals as a function of the received triggering signals (representative of the playing of an instrumentalist). This process 20 for production of sounds in real time generates the audio signals by additive synthesis according to the aforementioned formulae (1), (2) and (3), i.e. by cumulating the partials starting from the timbre coefficients and the triggering signals. This real-time calculation is very simple and requires only a very slight computing power.

FIG. 6 represents an algorithmic diagram, according to which the real-time process for production of the sounds is performed. In the course of an initialisation stage 201, taking place subsequent to the creation of the production process by the software for synthesis of piano sounds, the real-time process for production of the sounds recovers the values of timbre coefficients and of the excitation parameters recorded for its attention by the presynthesis process. In this connection it should be noted that the real-time process for production of the sounds can be adapted to wait to receive a signal transmitted by the presynthesis process, indicating to it that such data are actually available.

In stage 202, subsequent to stage 201, the real-time process for production of the sounds is placed in a stand-by state for reception of a triggering signal.

In stage 203, subsequent to stage 202, the real-time process for production of the sounds realises, in accordance with the formula previously described, the synthesis of a signal s(p,t) that is representative of a piano sound as a function of the values of the timbre coefficients and of the excitation parameters corresponding to a note p to be produced and to an intensity of striking of this note p, as determined by a received triggering signal. The real-time process for production of the sounds is preferably adapted to select the values of the excitation parameters corresponding to an intensity I of striking closest to that determined by the received triggering signal.

A percussive sound b(p,t) is added to the sum of the partials. The same prerecorded sound can be combined with each of the summed signals corresponding to the notes produced.

Preferably a plurality of noises b(p,t) of percussion are recorded for various notes p. In addition, nothing prevents recording various percussion noises, each one corresponding to various forces of impact of the hammer on the strings, with a view to producing a percussive sound for each note p played by the instrumentalist, by expressing the nuances of his/her playing in a more realistic manner.

Subsequent to the performing of stage 203, the real-time process for production of the sounds performs stage 202 again.

The real-time process for production of the sounds is preferably performed continuously until the software for synthesis of piano sounds signals to it to terminate.

Preferably several real-time processes for production of the sounds can be created, with a view to concurrent running of these processes on the same processor, or with a view to parallel running of these processes on several processors. In particular, a real-time process for production of the sounds can be created for each piano note p in such a way as to enable the simultaneous production of several audio signals, each one corresponding to a piano note p. These audio signals can be summed, for example by means of a hardware mixing module of the sound card, with a view to producing the audio signal transmitted to the amplifier.

Personal computers generally perform numerous processes which may impede the process flow of software for synthesis of piano sounds, such as that of the first example of the invention. In order to overcome this drawback, the data-processing system may be realised in the form of a dedicated system, specially configured in order to run software for synthesis of piano sounds, such as that of the first example of implementation of the invention. In particular, such a system may be realised by means of a microcomputer equipped with a restricted-access operating system in such a manner as to be able to run only the software for synthesis of piano sounds. Preferably such a system can be configured to enable possible updates and the transfer of backup files.

According to a second example of implementation of the invention, the device according to the invention can be realised in the form of an electronic keyboard (FIG. 4) of mechanical piano keys including a module (not represented) for digital processing, similar to the central processing unit of the first example of implementation. This module can be adapted to run on-board software similar to the software of the first example of implementation of the invention. In addition, this keyboard may include knobs 130, 131, 132 for control of parameters of weighting functions similar to those of the software of the first example of implementation. In addition, this keyboard may include a knob 134 for control of the deviation in tuning between the unison strings of the piano notes.

The device according to the invention can be implemented within a so-called silent system, making it possible to play on the keyboard of an acoustic piano without inconveniencing its surroundings. Such a system may include a mechanism for stopping the hammers of the acoustic piano before any impact on the strings, and sensors arranged in the region of the keyboard. In this example, a box constituting a device according to the invention is adapted to produce piano sounds in accordance with triggering signals generated by the sensors. These piano sounds can be amplified and transmitted to headphones connected to the box. Data-capture means of such a device may be provided in a form similar to those of the second example of implementation of the invention.

The devices given by way of example make it possible to realise a manual capture of the physical parameters by means of the keyboard, mouse etc. Nothing prevents implementing a device according to the invention that is adapted to enable a user to effect such a data capture by any other suitable means, for example by means of a system of voice recognition.

Also, in an alternative, nothing prevents using any means other than an interpolation function in order to calculate the timbre coefficients directly from the physical parameters. Use may be made, for example, of a reduced model of the dynamic system coupling the strings and the sounding-board of the stringed keyboard instrument.

Also, in an alternative, nothing prevents using any other method making it possible to determine the values of the excitation parameters $a_n(p)$ and $\theta_n(p)$ without requiring processing by modal analysis of measured exciting signals. Use may be made, for example, of a non-linear reduced model of the interaction between the hammer and the strings, making it possible to calculate directly the amplitudes and the phases relating to each partial for various striking forces of the hammer. In such an implementation, an equalising filter can simulate the effect of the sounding-board in accordance with the excitation frequencies, and the modal decomposition of the excitation then becomes pointless.

Moreover, nothing prevents employing physical parameters other than those of the first example of the invention. The physical parameters according to the invention may correspond to any other measurable physical property of the sounding-board or of the piano strings having an influence on the timbre of the sounds produced by a piano.

In particular, the sounding-board parameters may be representative of physical properties of the sounding-board corresponding to choices of instrument construction. These physical parameters include, in particular, parameters that are representative of the structure, of the behaviour under stresses, of the vibratory behaviour, of the size, of the materials, of the layout of the sounding-board and also of the parts that constitute it. By way of example, the dimension of the sounding-board in the thickness direction, in the length direction or in the width direction may constitute a sounding-board parameter according to the invention. In practice, a multiplicative factor of a dimension of the sounding-board may constitute such a physical parameter. Moreover, parameters that are representative of the shape of certain parts of the sounding-board may constitute sounding-board parameters according to the invention. In practice, a multiplicative factor of the radii of curvature of the contour of the sounding-board, front elevation, may constitute such a physical parameter. A weighting factor of the values of the matrix of the Hooke tensor may also constitute a sounding-board parameter according to the invention.

In addition, the sounding-board parameters may be representative of physical properties of the sounding-board that are not linked to choices of construction. By way of example, a sounding-board parameter may be representative of a moisture content of the sounding-board.

Nothing prevents employing string(s) parameters other than the tuning parameters of the first example of implementation of the invention. In particular, a parameter that is representative of the tension of a piano string can be employed for each string of the piano. It should be noted that such parameters constitute, in the case of notes with which several strings of the piano are associated, strings parameters that are representative of deviations in tuning between these unison strings of the notes of a piano.

In addition, string(s) parameters that are representative of the temperament of the piano may constitute strings parameters according to the invention.

Besides physical parameters that are representative of the setting (tensions, tuning, temperament etc.) of the strings of the instrument, the strings parameters may be representative of choices of construction of the instrument. By way of example, parameters that are representative of the number of strings for each note, parameters that are representative of the position of each string in relation to the sounding-board etc., may constitute strings parameters according to the invention.

It should be noted that a device according to the invention can be used by piano-makers as a tool for simulation of acoustic pianos with a view to their design, in order to have a representation of the sonority that is likely to be produced prior to the construction of the instrument. The data-capture means of the device according to the invention can be specially adapted for such a use. In this connection the device may include a large number of data-capture means, making it possible to determine with precision a large number of physical properties of the piano entering into the design choices of the piano-maker. By way of example, the device may include several data-capture means, in order to determine with precision the dimensions of the strings and of the various parts of the sounding-board. In addition, the device may include several data-capture means, in order to determine with precision the properties of the material making up each part of the sounding-board and the strings. The device may, in addition, include data-capture means corresponding to other parameters, such as the tension of each string etc.

Moreover, in a variant of the invention the data-capture means include means adapted to enable the user to modify, prior to its use by the module for production in real time, at least one timbre coefficient $f_n$, $d_n$ and/or at least one excitation parameter $a_n$, $\theta_n$ determined by the presynthesis module. For example, in the interface represented in FIG. 2 a modification cursor may be provided for each timbre coefficient and each excitation parameter. As an example of realisation, a cursor making it possible to modify each harmonic (for all the notes), or a graphical representation of the curve of the harmonics of each note capable of being adjusted by the user etc., may be provided.

It should be noted that the data-capture means of a device according to the invention can be specifically adapted with a view to use of the device as a teaching-aid within the context of courses that are given in order to train piano-tuners, as well as in schools of music.

The aforementioned examples of implementation of the invention can be transposed to stringed keyboard instruments other than the piano, for example the pantalon, the harpsichord, the clavichord, the fortepiano etc. By way of non-limiting example, the modelling by finite elements of the first aforementioned example may be modified accordingly. The exciting signals of this example may, in addition, be measured on the corresponding keyboard instrument.

The invention extends to a recording medium—in particular of the removable type (CD-ROM, DVD, USB key, external electronic hard disk etc.)—adapted to be capable of being read in a reader of a data-processing device and including a recorded computer program adapted in order to be capable of being loaded into the random-access memory of said data-processing device when this recording medium is loaded in said reader, this computer program being adapted so that, when it is loaded in the random-access memory of this data-processing device, this latter constitutes a device for production, by digital means, of signals that are representative of sounds according to the invention. In other words, the recording medium contains the software for synthesis of piano sounds as described above. Said data-processing device may be a computer, which may or may not be associated with an electronic keyboard as mentioned above.

The invention claimed is:

1. A device for production, by digital means, of signals that are representative of sounds having a sonority simulating that of an instrument having a keyboard and having strings that are linked to a sounding-board of the instrument, these sounds each corresponding to a note of the instrument, comprising:

at least one module for production of sounds by digital means in real time, adapted to produce at least one signal that is representative of a sound starting from at least one triggering signal relating to the playing of an instrumentalist, and by use of coefficients that are representative of at least one string parameter characteristic of at least one string of the instrument to be simulated and representative of a measurable physical property of said at least one string having an influence on the timbre of the sounds produced by the instrument, wherein, said device comprises at least one presynthesis module adapted to produce timbre coefficients that are representative of the damping of each exponentially damped sinusoidal partial composing a sound, and timbre coefficients that are representative of the frequency of each partial, said at least one presynthesis module producing said timbre coefficients starting from physical parameters comprising:

at least one sounding board parameter characteristic of a sounding-board of the instrument to be simulated and representative of a measurable physical property of this sounding-board having an influence on the timbre of the sounds produced by the instrument, said at least one string parameter, said at least one module for production, in real time, of sounds by digital means is adapted to produce at least one signal that is representative of a sound composed at least of a plurality of partials with said timbre coefficients produced by said at least one presynthesis module, and starting from at least one triggering signal relating to the playing of an instrumentalist.

2. The device claimed in claim 1, further comprises: a means for capture, by a user, of at least one physical parameter, said presynthesis module being adapted to produce the timbre coefficients from the captured physical parameters.

3. The device claimed in claim 1, wherein said at least one string parameter is distinct from said at least one sounding-board parameter.

4. The device as claimed in claim 1, further comprises: a means for capture of at least one sounding-board parameter.

5. The device claimed in claim 1, further comprises: a means for capture of at least one string parameter.

6. The device claimed in claim 1, wherein said at least one string parameter is representative of a deviation in tuning between at least two coupled strings corresponding to the note.

7. The device as claimed in claim 1, wherein said at least one sounding-board parameter is representative of at least one property of the material of the sounding-board.

8. The device as claimed in claim 1, wherein the physical parameters comprises, for a plurality of frequencies, at least one sounding-board parameter that is representative of the impedance of the sounding-board of the stringed keyboard instrument for each of these frequencies.

9. The device as claimed in claim 1, wherein the physical parameters comprises, for each note, at least one sounding-board parameter that is representative of the impedance of the sounding-board for each frequency of a plurality of frequencies associated with said note.

10. The device as claimed in claim 1, wherein the timbre coefficients are at least representative of the damping and of the frequency of each partial.

11. The device as claimed in claim 1, further comprises: a manual data-capture means.

12. The device as claimed in claim 1, wherein the presynthesis module is adapted to determine, from captured values of said physical parameters, the values of a plurality of modal elements including, besides said timbre coefficients, parameters of modal displacements that are representative of the fundamental modes of the coupled system of the sounding-board and of the strings.

13. The device as claimed in claim 12, wherein the presynthesis module is adapted to determine the values of the modal elements from a constellation of points stored beforehand, each associating a set of values of the physical parameters that are capable of being captured by a user with a set of values of modal elements.

14. The device claimed in claim 13, wherein the values of the modal elements of each point are determined beforehand in accordance with a mechanical modelling of the instrument that takes account of the coupling of the strings and of the sounding-board.

15. The device as claimed in claim 14, wherein said mechanical modelling takes account of deviations in tuning between the unison strings of the notes.

16. The device as claimed in claim 1, wherein the presynthesis module is adapted to determine excitation parameters that are representative of the initial amplitude $a_n(p)$ and of the phase difference $\theta_n(p)$ of each partial n of the notes.

17. The device claimed in claim 1, wherein the presynthesis module is adapted to perform at least one presynthesis process as a background task.

18. The device claimed in claim 1, wherein each triggering signal is formed from a message relating to actions of an instrumentalist on keys of a keyboard, in particular a MIDI message.

19. The device as claimed in claim 1, wherein the production module realises, in real time, the synthesis of a signal that is representative of a piano sound as a function of the values of the timbre coefficients and of the excitation parameters corresponding to a note p to be produced and with an intensity of striking of this note p as determined by a received triggering signal.

20. Device as claimed in claim 1, wherein the production module is adapted to produce an audio signal according to the formula (1):

$$s(p,t) = \sum_n a_n(p)\exp(-d_n(p)t)\sin\begin{pmatrix} 2\pi f_n(p)t + \\ \vartheta_n(p) \end{pmatrix} + b(p,t) \quad (1)$$

where:

t represents the time, p is a triggering signal identifying the note p and comprising at least the pitch of this note p and possibly the velocity and/or the duration of the note p, s(p,t) represents the audio signal produced, $d_n(p)$ represents the damping coefficient of a partial n corresponding to the note p, $f_n(p)$ represents the frequency of each partial n corresponding to the note p, $a_n(p)$ represents the initial amplitude of the partial n of the note p directly after the impact of the hammer on the strings of the note p, $\theta_n(p)$ represents the phase difference of the partial n from the note p, b(p,t) represents the percussive part of the sound and any other component of the sound that cannot be modelled (or that can only be poorly modelled) by a decomposition into a sum of sines.

21. The device claimed in claim 2, further comprises: a data-processing system incorporating software for synthesis of sounds simulating the sonority of a keyboard instrument, strings and sounding-board, this software for synthesis of sounds forming each presynthesis module and each module for production of sounds in real time, and exhibiting a suitable man machine interface to enable a user to form triggering signals and to present said means for capture of at least one physical parameter.

22. The device claimed in claim 21, wherein the stringed keyboard instrument to be simulated is a piano, and further comprising: at least one electronic keyboard with mechanical piano keys.

23. The device claimed in claim 1, wherein said data-capture means include comprises means adapted to enable the user to modify, prior to its use by the module for production in real time, at least one timbre coefficient $f_n$, $d_n$ and/or at least one excitation parameter $a_n$, $\theta_n$ determined by the presynthesis module.

24. A recording medium in particular of the removable type adapted to be capable of being read in a reader of a data-processing device and comprising a recorded computer program adapted to be capable of being loaded into the random-access memory of said data-processing device when this recording medium is loaded in said reader, wherein this computer program is adapted so that, when it is loaded in the random-access memory of this data-processing device, this latter constitutes a device for production, by digital means, of signals that are representative of sounds having a sonority simulating that of an instrument having a keyboard and having strings that are linked to a sounding-board of the instrument, these sounds each corresponding to a note of the instrument, said device comprising:

at least one module for production of sounds by digital means in real time, adapted to produce at least one signal that is representative of a sound starting from at least one triggering signal relating to the playing of an instrumentalist, and by use of coefficients that are representative of at least a string parameter characteristic of at least one string of the instrument to be simulated and representative of a measurable physical property of said at least one string having an influence on the timbre of the sounds produced by the instrument, at least one presynthesis module adapted to produce timbre coefficients that are representative of the damping of each exponentially damped sinusoidal partial composing a sound, and timbre coefficients that are representative of the frequency of each partial, said presynthesis module producing said timbre coefficients starting from physical parameters comprising:

at least one sounding-board parameter characteristic of a sounding-board of the instrument to be simulated and representative of a measurable physical property of this sounding-board having an influence on the timbre of the sounds produced by the instrument, said at least one string parameter, said at least one module for production, in real time, of sounds by digital means being adapted to produce at least one signal that is representative of a sound composed at least of a plurality of partials with said timbre coefficients produced by said at least one presynthesis module, and starting from said at least one triggering signal relating to the playing of an instrumentalist.

* * * * *